US006783276B2

(12) United States Patent
Machacek et al.

(10) Patent No.: US 6,783,276 B2
(45) Date of Patent: Aug. 31, 2004

(54) RECLOSABLE PACKAGING HAVING EXTENSIBLE FUNNEL AND SLIDER-OPERATED ZIPPER

(75) Inventors: Zdenek Machacek, Nanuet, NY (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/170,868

(22) Filed: Jun. 13, 2002

(65) Prior Publication Data

US 2003/0231808 A1 Dec. 18, 2003

(51) Int. Cl.[7] ..... B65D 33/00

(52) U.S. Cl. ..... 383/36; 383/63; 383/61.2; 383/64

(58) Field of Search ..... 383/36, 63, 64, 383/61.2, 47, 44, 3, 204, 904, 906

(56) References Cited

U.S. PATENT DOCUMENTS

| | | | | | |
|---|---|---|---|---|---|
| 1,950,571 | A | * | 3/1934 | Rubin | 5/644 |
| 2,273,128 | A | * | 2/1942 | Madsen et al. | 383/91 |
| 2,696,342 | A | * | 12/1954 | Toborg | 383/44 |
| 3,137,419 | A | * | 6/1964 | Davy | 222/527 |
| 3,746,215 | A | | 7/1973 | Ausnit et al. | |
| 3,991,801 | A | * | 11/1976 | Ausnit | 383/61.2 |
| 4,191,230 | A | * | 3/1980 | Ausnit | 383/61.2 |
| 4,196,030 | A | * | 4/1980 | Ausnit | 156/91 |
| 4,285,376 | A | * | 8/1981 | Ausnit | 383/203 |
| 4,657,792 | A | * | 4/1987 | Ausnit | 428/35.5 |
| RE34,554 | E | * | 3/1994 | Ausnit | 383/63 |
| 6,164,826 | A | * | 12/2000 | Petkovsek | 383/210.1 |
| 6,257,763 | B1 | * | 7/2001 | Stolmeier et al. | 383/63 |

FOREIGN PATENT DOCUMENTS

| | | | | | |
|---|---|---|---|---|---|
| JP | 03162247 | A | * | 7/1991 | 383/63 |

* cited by examiner

*Primary Examiner*—Jes F. Pascua
(74) *Attorney, Agent, or Firm*—Ostrager Chong Flaherty & Broitman P.C.

(57) ABSTRACT

A reclosable package has a slider-operated zipper and a flexible inner funnel bag that can be turned inside out to provide a spout for dispensing the package contents. Initially, the funnel bag is tucked inside the filled package in an unopened state. The funnel bag can be accessed by moving the slider in the opening direction to open the zipper and then reaching inside the funnel bag. The consumer then grasps a pull-out flap and pulls the funnel bag inside out. Then the tip of the funnel is snipped, cut or torn to provide a opening for dispensing product. The funnel directs the package contents, especially fine powders, away from the reclosable zipper profiles during dispensing so that one or both profiles do not become clogged with matter that might interfere with interlocking. The pull-out flap is formed by inverting and folding a distal portion of the funnel bag. The pull-out flap is preferably spot-sealed in position.

24 Claims, 8 Drawing Sheets

RECLOSABLE PACKAGING HAVING EXTENSIBLE FUNNEL AND SLIDER-OPERATED ZIPPER

BACKGROUND OF THE INVENTION

This invention generally relates to reclosable pouches, bags or other packages having a flexible zipper. In particular, the invention relates to such a reclosable package having an internal funnel portion that is readily extensible outside of the package to act as a spout for controllably dispensing the contents of the package.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

Conventional slider-zipper assemblies typically comprise a plastic zipper having two interlocking profiles and a slider for opening and closing the zipper. In one type of slider-zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Another type of slider-zipper assembly avoids the use of a separating finger. For example, U.S. Pat. No. 6,047,450 discloses a zipper comprising a pair of mutually interlockable profiled structures. The first profiled structure comprises an interlocking element on a surface directed toward the second profiled structure and an integral base directed away from the second profiled structure. Likewise, the second profiled structure comprises an interlocking element on a surface directed toward the first profiled structure and an integral base directed away from the first profiled structure. Additionally, portions of the two profiled structures form a fulcrum about which the profiled structures may be pivoted out of engagement when lower edges of the bases are forced towards each other It is known to form a zippered reclosable package on a form, fill and seal apparatus. If the reclosable package is filled with a fine powder product, then the fine powder or particulate matter can clog one or both of the interlockable profiled elements, thereby degrading the performance of the zipper by blocking interlocking of the elements. Powder or particulate matter can also clog interior recesses of a slider.

One known means for preventing the contents of a package from interfering with the operation of a flexible zipper is to provide a funnel for channeling the contents past the zipper and out of the package. U.S. Pat. No. 3,746,215 discloses a flexible container having rib and groove elements wherein a funnel portion is provided interior to the container, which funnel portion may be extended outwardly of the container to act as a pouring spout. The funnel portion is normally positioned inwardly of the container, but can be reversed and turned inside out to extend outwardly of the container to cause its contents to bypass the rib and groove elements of the zipper. The funnel portion is attached to the inner walls of the container and, when in a flattened folded state, has the general shape of a triangle with a tip portion or apex that may be slit when the funnel portion is extended outwardly to act as a pouring spout. The funnel portion is so hinged to the walls of the container that it is easily reversible by the weight of the contents when the container is turned upside down.

There is a need for a funnel bag having an improved design to facilitate ease of use.

BRIEF DESCRIPTION OF THE INVENTION

The invention is directed to reclosable packages comprising a flexible zipper and a flexible funnel that can be turned inside out to provide a spout for dispensing the package contents. The embodiments of this reclosable package comprise a slider-operated zipper or an internal funnel having a portion including a terminus that is inverted and folded to provide a pull-out flap. The pull-out flap can be accessed by moving the slider in the opening direction. The consumer can then reach inside the open package, grasp the pull-out flap using an index finger and thumb, and pull the flap out of the interior volume of the package, thereby turning the funnel inside out. Then the tip of the funnel is snipped, cut or torn to provide an opening for dispensing product. The funnel directs the package contents, especially fine powders, away from the reclosable zipper profiles so that one or both profiles do not become clogged with matter that might interfere with the interlocking of zipper parts. The funnel also directs the contents of the package away from the slider when a slider is used to open the zipper.

One aspect of the invention is a package comprising: a receptacle having an interior volume and a mouth; a flexible zipper comprising first and second interlockable zipper parts that are interlocked to close the mouth and separated to open the mouth; a slider mounted to and cooperating with the zipper; and a flexible funnel portion projecting into the interior volume when in a retracted position and extending through the mouth and outside the receptacle when the mouth is open and the flexible funnel portion is turned inside out.

Another aspect of the invention is a package comprising: an outer bag having an interior volume and a mouth; a flexible zipper comprising first and second interlockable zipper parts that are interlocked to close the mouth and separated to open the mouth; a slider mounted to and cooperating with the zipper; and an inner bag residing in the interior volume when in a retracted position and extending through the mouth and outside the outer bag when the inner bag is turned inside out.

A further aspect of the invention is a package comprising: an inner bag comprising a funnel portion, a mouth, and a flexible zipper comprising first and second interlockable zipper parts that are interlocked to close the mouth and separated to open the mouth; a slider mounted to and cooperating with the zipper; and an outer bag joined to the inner bag and surrounding the funnel portion of the inner bag when the funnel portion is in a retracted position. The funnel portion extends through the mouth of the inner bag and is not surrounded by the outer bag when the funnel portion is turned inside out.

Yet another aspect of the invention is a package comprising: a receptacle having an interior volume and a mouth; a flexible zipper comprising first and second interlockable zipper parts that are interlocked to close the mouth and separated to open the mouth; and a flexible funnel portion projecting into the interior volume when in a retracted position and extending through the mouth and outside the receptacle when the mouth is open and the flexible funnel portion is turned inside out. A portion of the funnel portion including a terminus is inverted and folded along a fold line. The inverted portion is directed toward the mouth when the funnel portion is in the retracted position.

A further aspect of the invention is a package comprising: an outer bag having an interior volume and a mouth; a flexible zipper comprising first and second interlockable zipper parts that are interlocked to close the mouth and separated to open the mouth; and an inner bag residing in the interior volume when in a retracted position and extending through the mouth and outside the outer bag when the inner bag is turned inside out. A portion of the inner bag including a terminus is inverted and folded along a fold line. The inverted portion is directed toward the mouth when the inner bag is in the retracted position.

Another aspect of the invention is a package comprising: an inner bag comprising a funnel portion, a mouth, and a flexible zipper comprising first and second interlockable zipper parts that are interlocked to close the mouth and separated to open the mouth; and an outer bag joined to the inner bag and surrounding the funnel portion of the inner bag when the funnel portion is in a retracted position, wherein the funnel portion extends through the mouth of the inner bag and is not surrounded by the outer bag when the funnel portion is turned inside out. A portion of the funnel portion including a terminus is inverted and folded along a fold line. The inverted portion is directed toward the mouth when the funnel portion is in the retracted position.

When the funnel is made of the same material as the outer bag, the funnel also provides a hermetic seal that prevents any air getting through the zipper and spoiling the contents of the outer bag. In addition, the funnel provides a tamper-evident feature.

Other aspects of the invention are disclosed and claimed below.

DETAILED DESCRIPTION OF THE INVENTION

Figure 1:
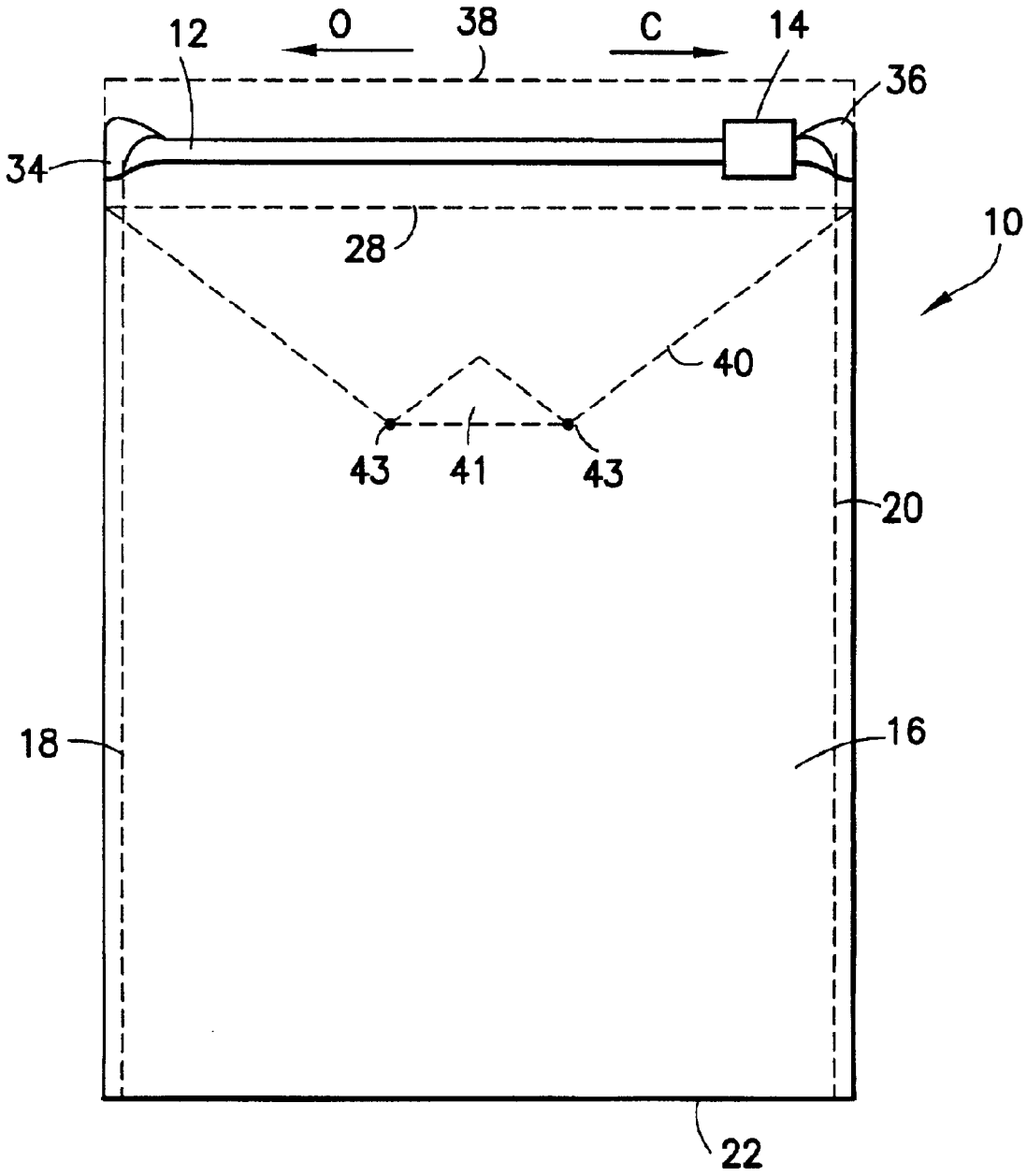
FIG. 1 is a schematic showing an elevational view of a package having a funnel bag and a slider-operated zipper in accordance with one embodiment of the invention. The inner funnel bag is shown in a retracted position on the product side of the zipper and in an unopened state.

The present invention relates to packages designed to hold pourable material, such as liquid or granular solid. Such packages may take the form of pouches or bags. Reclosable fastener assemblies are useful for sealing such bags. Such fastener assemblies often include a plastic zipper with or without a slider. Typically, the plastic zippers include a pair of interlockable profiled fastener elements that form a closure. In zippered bags with sliders, as the slider moves across the zipper, the zipper is opened or closed. The zipper profiles may take any form. For example, the zipper may comprise interlocking rib and groove elements or alternating hook-shaped closure elements. The profiles may be extruded separately and attached to the respective sides of the bag or the profiles may be extruded integrally with the sides of the bag.

Although the embodiments depicted in the drawings (described in detail below) each comprise a funnel bag inside an outer bag and a slider-operated zipper, the aspect of the invention wherein a portion of the funnel bag including a terminus is inverted and folded along a fold line to provide a pull-out flap can be employed in packages with or without sliders.

The interlocking rib and groove elements are well known in the art and many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements. The rib and groove elements may be carefully formed of a soft flexible material in part thereof so that the contents of the package are in fact relatively hermetically sealed from the outside.

It is common to use such flexible packages to hold a variety of substances, such as fine powders or the like. It has been discovered, however, that in removing only a portion of such powders from the package, the resealability of the package may be impeded by the presence of small granules of material in between the rib and groove elements. The rib and groove elements can be relatively small elements and it is important that granules of material from the contents of the package do not become trapped in the groove, for any such granules of material could easily prevent the rib from being pressed sufficiently deeply into the groove to become interlocked.

The present invention provides a means for allowing the contents of such a zippered package to be readily removed from the package and to do so in such a way as to bypass the zipper elements. This is accomplished generally by providing a bag-within-a-bag type of arrangement wherein an inner bag is connected to the inner walls of an outer bag at an elevation below the interlockable profiled zipper elements. The contents of the package are contained in the volume between the inner and outer bags.

In one embodiment of the invention, the inner bag comprises a funnel portion that can be opened at its distal end or apex. The funnel portion may have the shape of a triangle. When the apex is snipped with a pair of scissors or torn along a line of perforations, the contents may be controllably dispensed from the package by using the funnel portion of the inner bag as a spout.

In one embodiment, the inner bag is made of the same type of flexible material as the outer bag and is secured to the inner surface of the walls of the outer bag just below or inwardly of the rib and groove elements. Therefore, when the rib and groove elements are closed, the inner bag is directed inwardly of the outer bag and serves as a hermetic seal. However, when it is desired to remove the contents of the package, the zipper is opened and the funnel portion of the inner bag is merely inverted or turned inside out. The weight of the contents will force the funnel portion to extend outwardly of the package, past the rib and groove elements. In this way the contents of the package fall into the inverted funnel portion, never touching the rib and groove elements. Alternatively, the inner and outer bags can be made of different materials. In its unopened state, the funnel gives extra protection to the contents of the bag in the event of accidental opening of the zipper and provides evidence of tampering.

The inner bag may be heat sealed or fused to the inner walls of the package and preferably in such a fashion so that the funnel may be easily turned inside out to extend outwardly of the package. On the one hand, if the zipper profiles are extruded onto the outer bag walls, then the inner bag is heat sealed or fused to the walls of the outer bag. On the other hand, if the zipper is extruded, cooled and then applied to the outer bag, then each zipper element preferably comprises a profiled interlockable element and an extension flange. In the latter case, the walls of the outer bag can be heat sealed or fused to the outer surfaces of the extension flanges, while the walls of the inner bag are heat sealed or fused to the inner surfaces of the extension flanges.

After a desired quantity of material is dispensed from the package, the funnel portion is merely pushed and tucked back into the interior of the outer bag, resuming its uninverted configuration, and then the rib and groove elements of the zipper are closed in the normal manner. The powder or other contents that filled the funnel when the latter was turned inside out is then returned to the interior volume of the receptacle. Because the powder or other material in the package has not come into contact with the rib and groove elements, a completely reliable resealing of the rib and groove elements is made possible.

Reference will now be made to the drawings, in which similar elements in different drawings bear the same reference numerals. A reclosable package or bag 10 having a flexible plastic zipper 12 operated by manipulation of a slider 14 is shown in FIG. 1. The bag 10 may be made from any suitable sheet material or plastic film and comprises opposing wall panels (only the front panel 16 is visible in FIG. 1), which may be secured together at opposite side edges of the bag by seams 18 and 20 (indicated by dashed lines). The opposing bottoms of the wall panels may be joined, for example, by means of a heat seal made in conventional fashion, e.g., by application of heat and pressure or ultrasonic energy. Typically, however, the bottom of the package is formed by a fold 22 in the original packaging film, as seen in FIG. 1.

Figure 2:
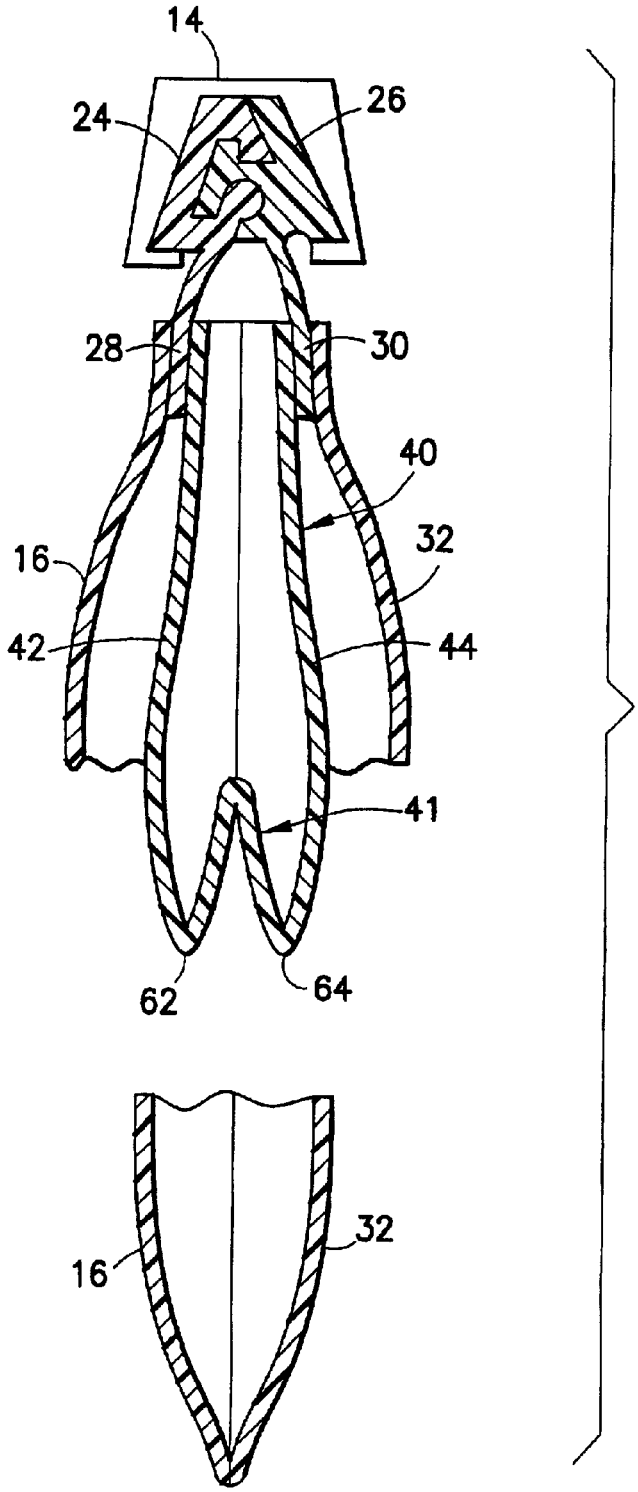
FIG. 2 is a schematic showing a sectional view of part of the package shown in FIG. 1.

At its top end, the bag 10 has an openable mouth, on the inside of which an extruded plastic zipper 12 is attached. The zipper 12 comprises a pair of interlockable fastener strips or zipper halves 24 and 26 (best seen in FIG. 2). Although FIG. 2 shows a rib and groove arrangement, the profiles of the zipper halves may take any form. For example, the zipper may comprise interlocking rib and groove elements or alternating hook-shaped closure elements. The preferred zipper material is polyethylene.

The front and rear bag wall panels 16, 32 (seen in FIG. 2) are respectively sealed to the zipper halves by heat fusion or welding. Alternatively, the interlockable zipper halves can be attached to the wall panels by adhesive or bonding strips or the zipper profiles can be extruded integrally with the bag material. For the purpose of joinder, the zipper halves may be provided with respective extension flanges 28, 30, to which an upper portion of the respective bag wall panel is fused or welded. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The bag material may be either transparent or opaque. The bottom edge of extension flange 28 is indicated by a dashed line in FIG. 1 for the case where the bag wall panels are opaque.

Optionally, the bag 10 may be provided with an enclosed header 38, indicated by dashed lines in FIG. 1, which encompasses the zipper and the slider. Alternatively, the header may be provided with openings in both the front and rear panels of the header at the closed position of the slider, with the openings being sized and shaped to allow the slider to protrude through the openings on both sides of the header. The header 38 may be a panel or strip formed from the same material as that comprising the walls of the package or from the same material as that comprising the zipper or from an entirely separate material. More specifically, the header may comprise a panel of thermoplastic material that is heat sealed or ultrasonically welded to either the zipper flanges or the package walls. Alternatively, the header may be formed as an extension of the zipper flanges or the package walls.

In zippered bags with sliders, as the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The slider for opening or closing the reclosable zipper is generally shaped so that the slider straddles the zipper profiles. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The bag shown in FIG. 1 further comprises end stops 34 and 36 for preventing the slider from sliding off the end of the zipper when the slider reaches the closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper profiles themselves. The stomped end stops comprise sections of the profiles that have been fused together and flattened proximate to the open and closed slider positions. During deformation, thermoplastic zipper material flows upward such that the end stops are raised in height above the peak of the undeformed zipper on which the slider rides.

The package 10 further comprises an inner bag 40 having a funnel shape, indicated by dashed lines in FIG. 1. In accordance with one aspect of the invention, the distal portion of the funnel-shaped inner bag 40 is inverted (i.e., turned upwards) and folded to form a flap 41 that allows the user to pull out the funnel bag when the package is open. The flap 41 is sealed into position using any conventional joining means. In the embodiment shown in FIG. 1, seals are made at respective spots 43 at opposite ends of the fold lines at the base of the pull-out flap. However, only one spot seal may be sufficient. Alternatively, the entire fold line may be sealed. The fold lines at the base of the pull-out flap 41 are designated by reference numerals 62 and 64 in FIG. 2.

As seen in FIG. 2, the inner bag 40 is heat sealed or otherwise joined to the extension flanges 28 and 30 of the respective zipper parts 24 and 26. Likewise, the walls 16 and 32 of the outer bag are heat sealed or otherwise joined to the extension flanges. Both the inner and outer bag walls may comprise a laminated film wherein the layer adjoining the extension flanges of the zipper (i.e., the outer layer of the inner bag and the inner layer of the outer bag) is made of low-melting-point sealant material. The extension flanges themselves may also have a laminated structure with low-melting-point sealant material comprising the outer layers.

As seen in FIG. 2, the outer bag wall 32 is joined to the outer surface of extension flange 30 of the ribbed element 26 while inner bag wall 44 is joined to the inner surface of extension flange 30, whereas outer bag wall 16 is joined to the outer surface of extension flange 28 of the grooved element 24 while inner bag wall 42 is joined to the inner surface of extension flange 28. Alternatively, the inner bag walls 42 and 44 could be joined directly to outer bag walls 16 and 32 respectively.

The person skilled in the art will readily appreciate that the attachment of the bags to extension flanges is not necessary to practice of the invention. The interlockable profiles of the zipper could instead be extruded directly onto the outer bag film and then the inner bag could be joined to the outer bag.

Figure 3:
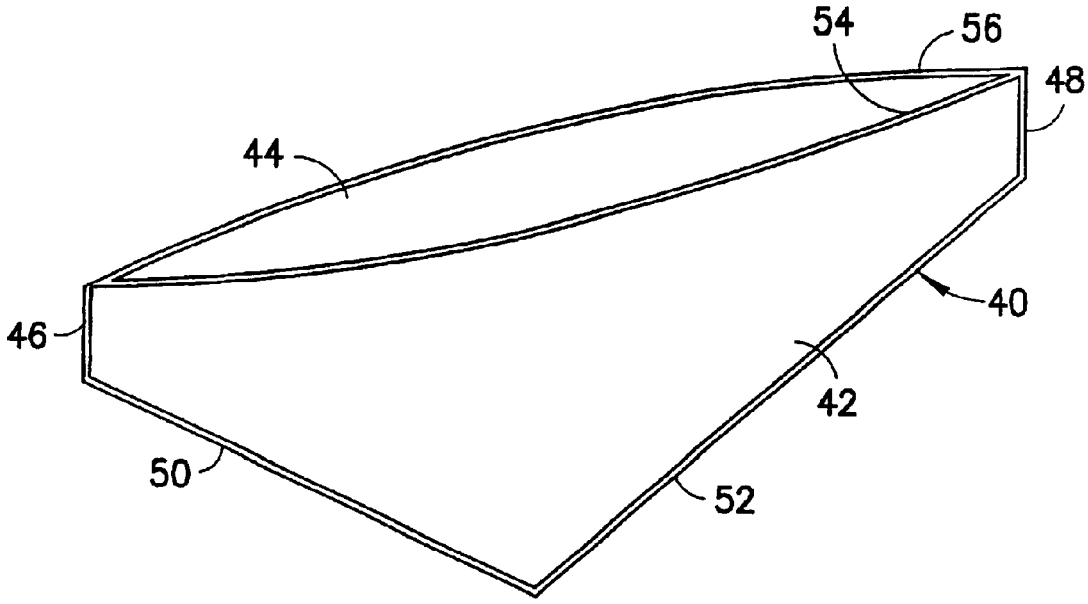
FIG. 3 is a schematic showing an isometric view of an inner bag as it would appear prior to being inserted into an outer bag to form the embodiment shown in FIG. 1.

The configuration of the inner bag 24 is shown more clearly in FIG. 3. The inner bag 24 comprises a pair of walls 42 and 44, each wall being in the shape of a five-sided polygon. Walls 42 and 44 are heat sealed along side edges 46 and 48 to the sides of the outer bag (and to each other), and are heat sealed along diagonal edges 50 and 52 to each other but not to the outer bag walls. Preferably, side edges 46 and 48 are mutually parallel. Walls 42 and 44 respectively have top edges 54 and 56 that are preferably perpendicular to the parallel side edges 46 and 48.

Figure 4:
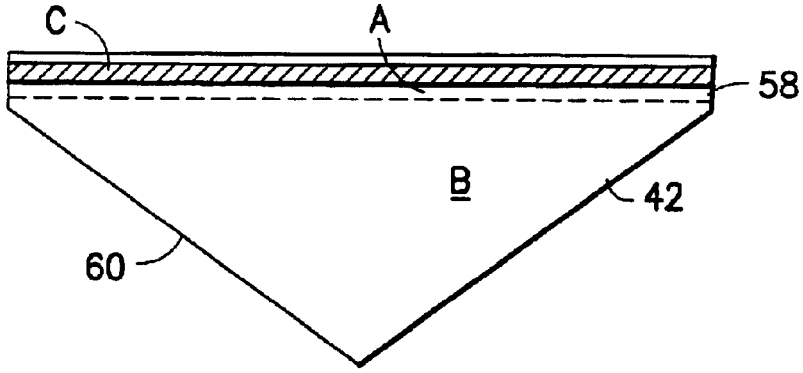
FIG. 4 is a schematic showing the geometry of non-inverted funnel bag of the type incorporated in the embodiment shown in FIG. 1.

In the embodiment shown in FIG. 4, wall 42 of the inner bag comprises a rectangular area A and a triangular area B separated by the dashed line. Preferably wall 44 has the identical shape and size. The areas A of walls 42 and 44 form a base portion 58 of the inner bag 24, while the areas B of walls 42 and 44 form a funnel portion 60 of the inner bag 24. Portions of the rectangular areas A of walls 42 and 44, e.g., transverse strip-like areas C, are heat sealed or otherwise joined to either the respective extension flanges or the respective outer bag walls. In accordance with other embodiments, area B may have any non-triangular shape that would be suitable for use as a funnel when the closed tip is cut off, such as a trapezoid; a peaked shape comprising a straight base and two inverted arcs that meet at the peak; a truncated version of the aforementioned shape wherein inverted arcs meet at opposing ends of a straight base and a straight distal end; and so forth.

The height of the rectangular area A needs to be equal to or greater than the height of the joining zones C. The joining zones C preferably run continuously from one side edge 16 to the other side edge 18 of outer bag 20, forming a continuous closed perimeter joining the inner bag to the zipper extension flanges (or, in an alternative, to the outer bag). Thus the inner bag, prior to snipping off of the funnel apex, forms a tamper-evident membrane that blocks access to the package contents when the zipper is open.

Figure 5:
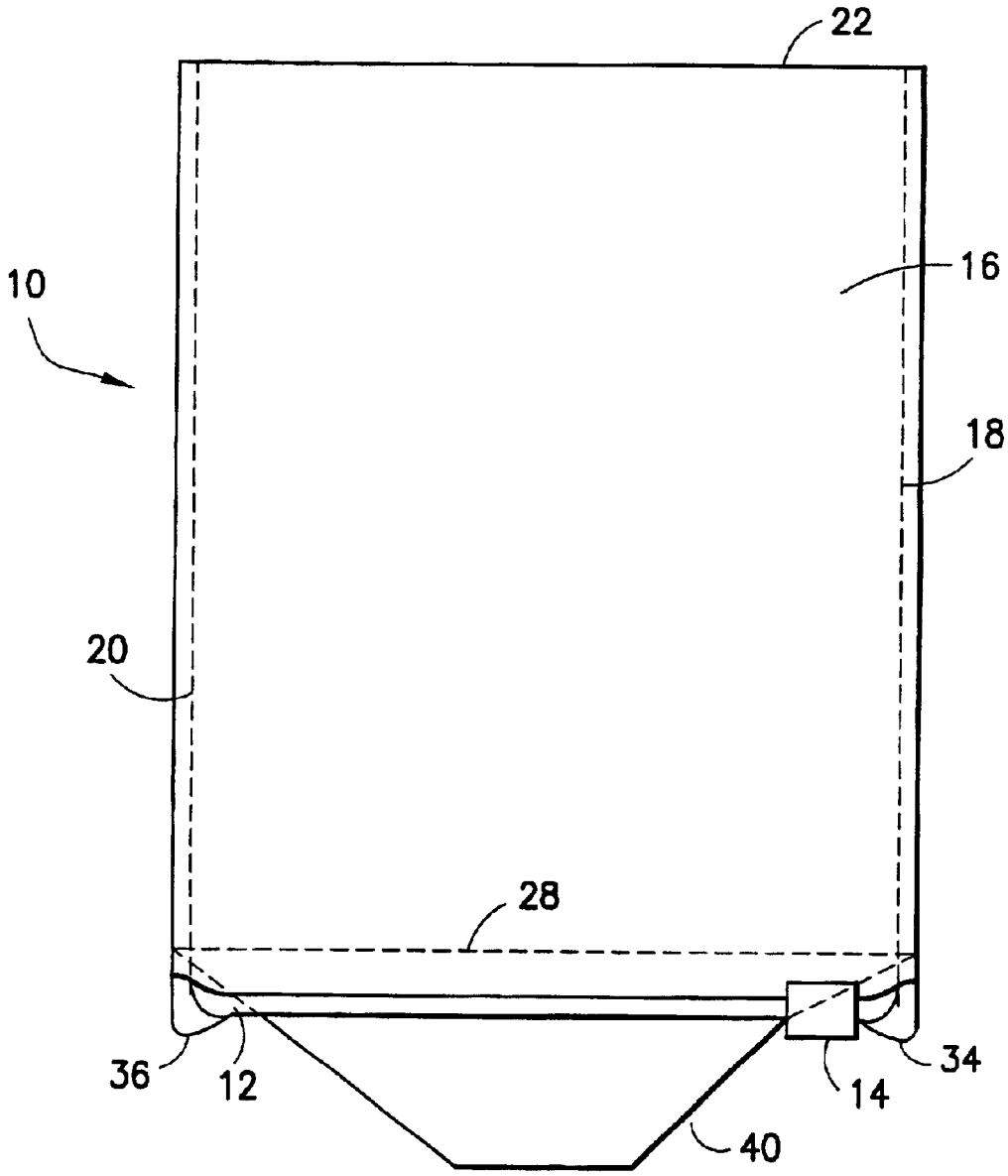
FIG. 5 is a schematic showing an elevational view of the package of FIG. 1, the funnel bag being shown in a fully extended position and an opened state.
Figure 6:
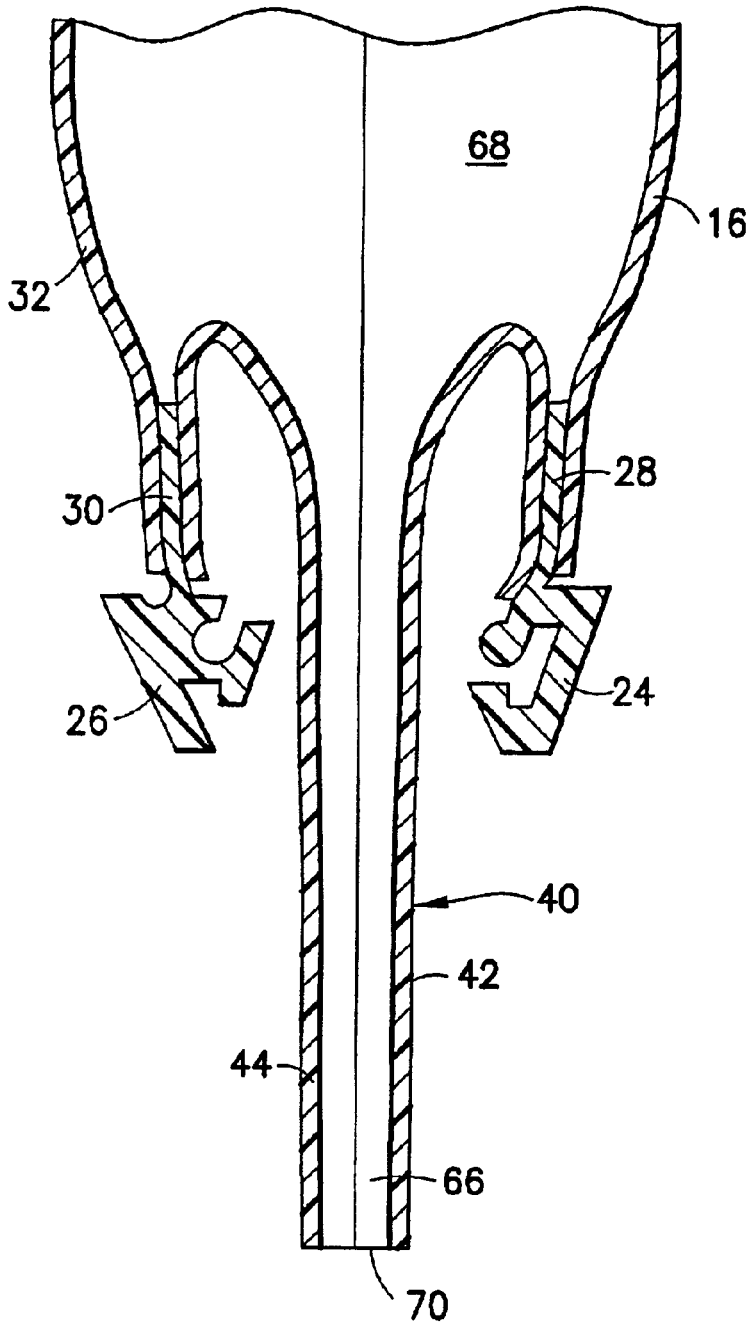
FIG. 6 is a schematic showing a sectional view of part of the package shown in FIG. 5, including the inverted, extended and opened funnel bag.

In FIG. 2 the funnel portion is shown projecting inwardly of the outer bag, and the interlocking rib and groove elements 24 and 26 are shown in the locked position. When the funnel is made of the same material as the outer bag, the funnel provides a hermetic seal that prevents any air getting through the zipper and into the interior volume of the outer bag. In FIG. 5 the package 10 is shown in the upside-down position with the truncated and open apex of the funnel portion extending outwardly of the zipper 12. FIG. 6 shows an enlarged view of a section of the package of FIG. 5, showing the passageway that is provided within the inverted funnel portion of the inner bag 40 and that may carry contents from the interior 64 of the outer bag directly to the opening 66 of the snipped spout. Also, the shielding effect of the walls 42 and 44 of the inner bag 40 is illustrated. When it is desired to reseal the package, the funnel portion of the inner bag 40 is merely tucked back into the package and the rib and groove elements of the zipper 12 are sealed by moving the slider in the closing direction (C in FIG. 1).

Figure 8:
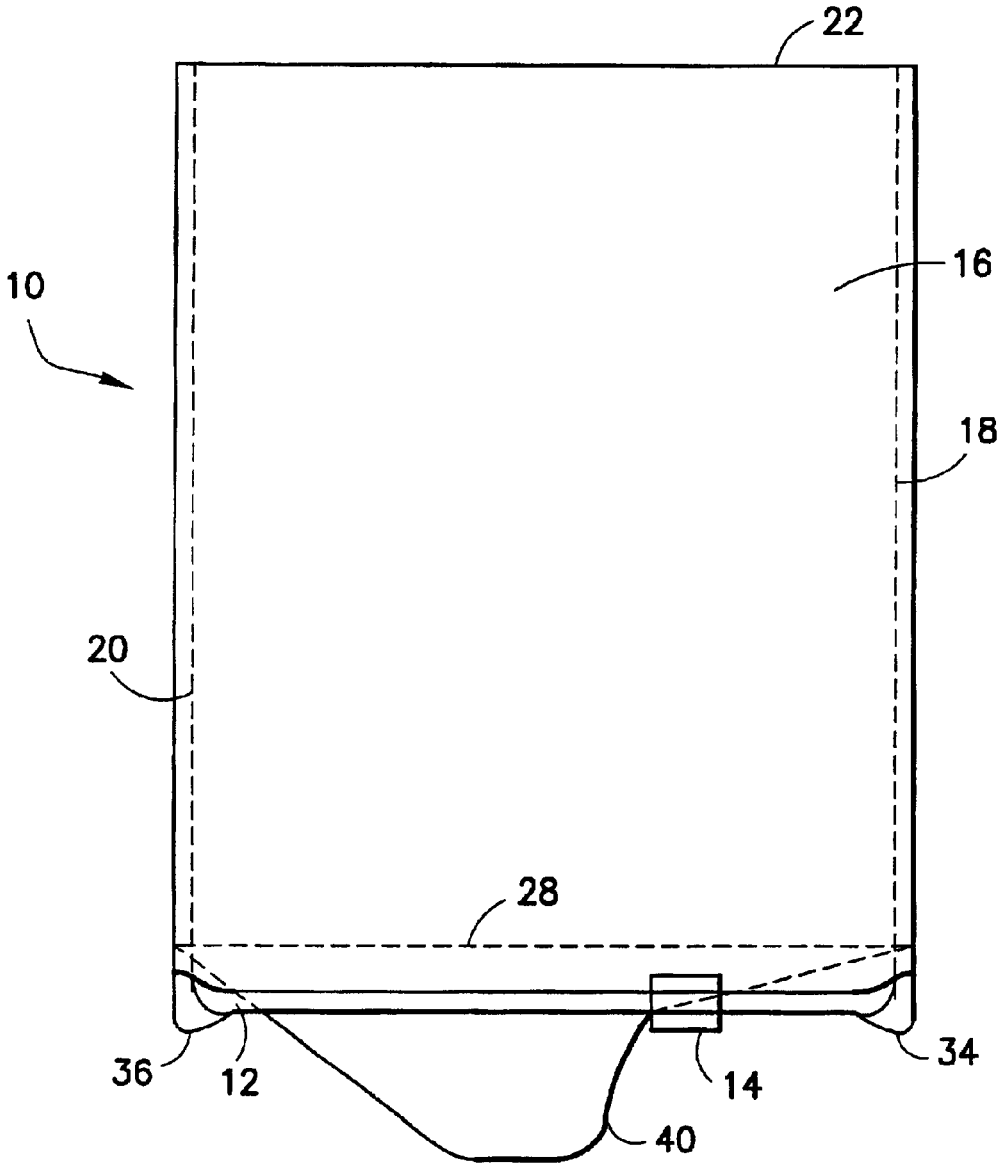
FIG. 8 is a schematic showing an elevational view of the package of FIG. 5, the extended funnel being narrowed by placement of the slider at an intermediate position.

FIG. 8 demonstrates a feature whereby the size of the funnel opening can be controlled or adjusted by movement of the slider 14. As compared to FIG. 5 wherein the slider is in the fully open position and the funnel is fully open, in FIG. 8 the slider 14 is shown displaced from the fully open position to a position whereat the funnel opening is partially closed. As the slider moves leftward, it engages the protruding the funnel bag and cams the abutting portion of the funnel bag inward towards the interior of the outer bag. The result is a decrease in the open cross-sectional area of the funnel bag at the zipper line. The resulting deformation of the inner bag also constricts the funnel opening. In this manner, the flow rate of the package contents through the funnel opening can be controlled by proper positioning of the slider.

By providing a device as shown, an improved resealability for flexible packages having rib and groove elements is accomplished. In addition, an improved means of pouring the contents from the package is also achieved. Also, the funnel provides a tamper-evident feature. Additional security is provided for the package contents, up to the time it is first used, in the event of accidental opening of the zipper.

Figure 7:
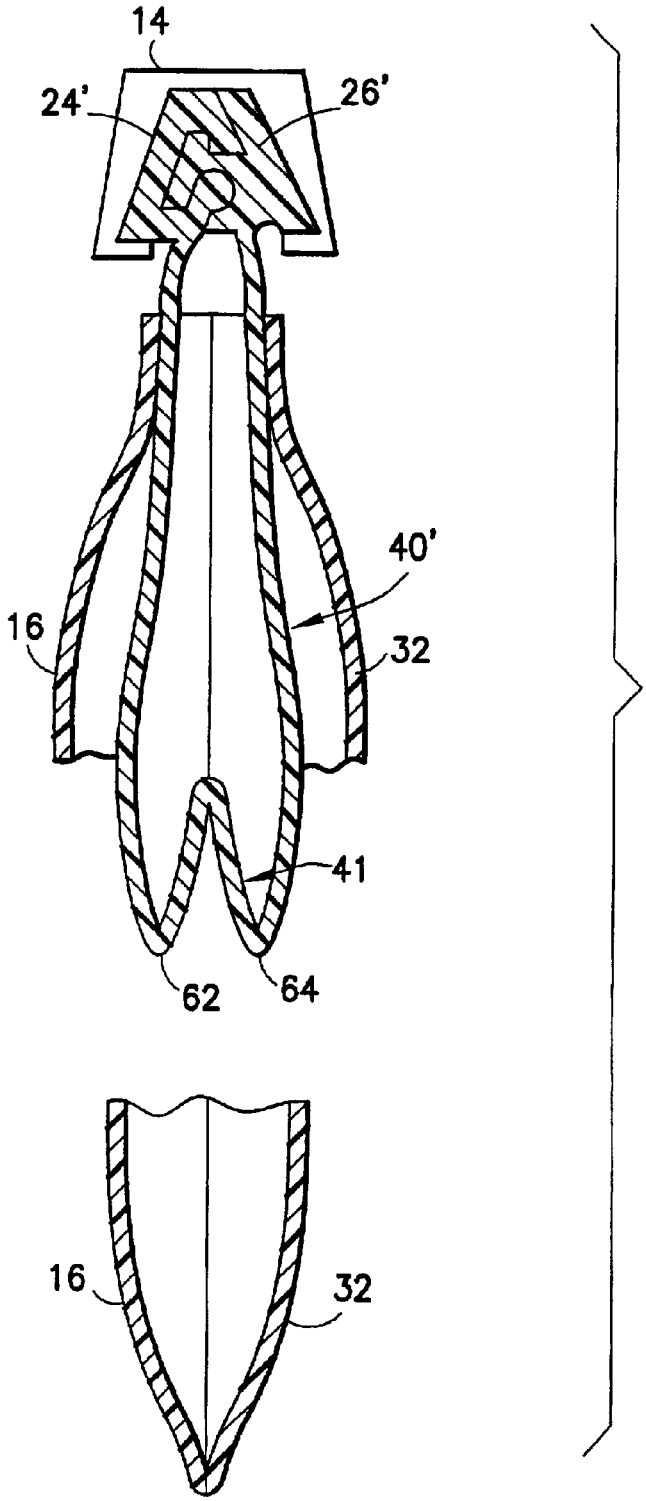
FIG. 7 is a schematic showing a sectional view of part of a package in accordance with another embodiment of the invention.

In accordance with another embodiment of the invention, shown in FIG. 7, a zippered funnel bag 66 can be formed by extruding the male and female zipper profiles 24' and 26' directly onto a web of film material, folding the web of film material, interlocking the zipper profiles, and then heat sealing the film material along a line to form a periphery of the funnel bag 40'. The tip of the bag 40' is then inverted and spot sealed at the ends of the fold lines 62 and 64 to form a pull-out flap 41. The opposing walls 16 and 32 of a second folded web of film material are then heat sealed to the funnel bag at an elevation below the zipper and then side sealed. The outer bag can be slit open and filled at the bottom. After filling, the bottom is resealed by heat sealing. Alternatively the walls 16 and 32 can be formed by separate webs which are side sealed, leaving an opening at the bottom for filling the package.

As will be appreciated by a person skilled in the art, the zipper profiles and funnel bag can be extruded as one piece, or the zipper profiles and the outer bag can be extruded as one piece, or zipper profiles with extension flanges can be extruded separately and then heat sealed to either the funnel bag or the outer bag.

Figure 9:
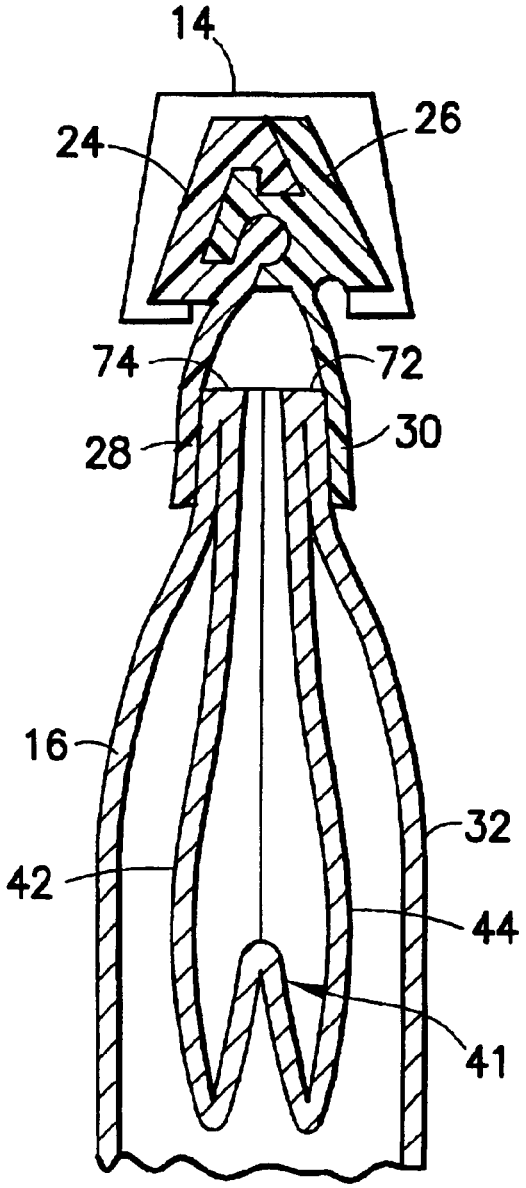
FIG. 9 is a schematic showing a sectional view of part of a package in accordance with yet another embodiment of the invention.

In accordance with yet another embodiment of the invention, shown in FIG. 9, the funnel bag is formed by cutting overlapping webs of packaging film along a line corresponding to the funnel bag profile and then sealing the webs of film together at the sides and along the cutting line. The side seals will belong to the outer bag while the seals along the cutting lines will belong to the inner funnel bag. At this point in the process, the funnel bag is in the extended position, without a pull-out flap, and the bottom of the bag is open. The funnel bag is then inverted, i.e., tucked inside the outer bag, as seen in FIG. 9. The funnel bag has walls 42 and 44, while the outer bag has walls 16 and 32. This is accomplished by folding the plastic film along fold lines 72 and 74. Then the distal portion of the funnel bag is inverted to form a pull-out flap 41. Next, the extension flanges 28 and 30 of the zipper halves 24 and 26 are joined to the outer bag walls 16 and 32 in the vicinity of the fold lines 74 and 72, respectively, and a slider is inserted on the zipper. Although not shown, the bag can then be filled from the bottom. After filling, the bottom of the package is cross sealed in conventional manner.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments failing within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the specification and claims, the terms "funnel" and "funnel portion" include structures that narrow as the tip is approached. The term "funnel" is not used herein in the sense of a precisely conical utensil, as might be understood by persons not skilled in the art of reclosable packaging. In addition, the terms "funnel" and "funnel portion" should be construed broadly to include structures that are open at a terminal portion and structures that are closed at a terminal portion. In the latter case, the closed terminal portion must eventually be opened in order to dispense the package contents via the funnel. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

What is claimed is:

1. A package comprising:

a flexible outer bag comprising first and second outer bag walls defining an interior volume and a mouth;

a flexible plastic zipper comprising first and second interlockable zipper parts having respective complementary profiles that are interlocked to close said mouth and separated to open said mouth, said profiles being substantially constant along the portions of said zipper parts that are interlockable; and a flexible inner bag comprising a funnel portion that depends from said zipper or said outer bag in a retracted state and a flap portion that is inverted relative to said funnel portion and closes a distal end of said funnel portion, said funnel portion comprising first and second inner bag walls, and said flap portion comprising first and second flap walls respectively integrally connected to said first and second inner bag walls at first and second fold lines, said funnel portion projecting into said interior volume when in said retracted state and passing through said mouth and projecting outside said outer bag when said mouth is open and said funnel portion is turned inside out by pulling said flap portion out of said interior volume of said outer bag said flap portion having an area large enough to be grasped by a consumer, and said funnel portion and said flap portion being made of the same material.

2. The package as recited in claim 1, wherein said first zipper part comprises a first extension flange and said second zipper part comprises a second extension flange, and said inner bag further comprises first and second base portions integrally formed with said first and second inner bag walls of said funnel portion and joined to said first and second extension flanges.

3. The package as recited in claim 1, further comprising a slider mounted to and cooperating with said zipper, said slider causing portions of said first and second interlockable zipper parts to interlock when said slider is moved in a first direction and to separate when said slider is moved in a second direction opposite to said first direction.

4. The package as recited in claim 1, wherein said outer bag and said inner bag are integrally formed and connected at fold lines.

5. The package as recited in claim 1, wherein said zipper and said inner bag are integrally formed.

6. The package as recited in claim 1, wherein said first zipper part comprises a first extension flange and said second zipper part comprises a second zipper flange, said first inner bag wall being joined to an inner surface of said first extension flange, said first outer bag wall being joined to an outer surface of said first extension flange, said second inner bag wall being joined to an inner surface of said second extension flange, and said second outer bag wall being joined to an outer surface of said second extension flange.

7. The package as recited in claim 1, wherein each of said first and second inner bag walls of said funnel portion is generally trapezoidal in shape.

8. The package as recited in claim 1, wherein each of said first and second flap walls is generally triangular in shape.

9. The package as recited in claim 1, wherein a portion of said funnel portion is sealed at said fold lines.

10. A package comprising:

a receptacle having an interior volume and a mouth;

a flexible zipper comprising first and second interlockable zipper parts that are interlocked to close said mouth and separated to open said mouth;

a flexible funnel portion projecting into said interior volume when in a retracted position and extending through said mouth and outside said receptacle when said mouth is open and said funnel portion is turned inside out; and a flap connected to and disposed inside said funnel portion when said funnel portion is in said retracted position, said flap having an area large enough to be grasped by a consumer, wherein said funnel portion and said flap are integrally formed and are connected along a fold line, said inverted portion being directed toward said mouth when said funnel portion is in said retracted position, and wherein portions of said funnel portion are fused at said fold line.

11. A package comprising:

an outer bag having an interior volume and a mouth;

a flexible zipper comprising first and second interlockable zipper parts that are interlocked to close said mouth and separated to open said mouth; and an inner bag residing in said interior volume when in a retracted position and extending through said mouth and outside said outer bag when said inner bag is turned inside out, wherein a portion of said inner bag forms a flap having an area large enough to be grasped by a consumer, said flap is formed by a portion of said inner bag that includes a terminus of said inner bag and that is inverted and folded along a fold line, said inverted portion being directed toward said mouth when said inner bag is in said retracted position, and portions of said inner bag are fused at said fold line.

12. The package as recited in claim 11, further comprising a slider mounted to and cooperating with said zipper, said slider causing portions of said first and second interlockable zipper parts to interlock when said slider is moved in a first direction and to separate when said slider is moved in a second direction opposite to said first direction.

13. The package as recited in claim 11, wherein said inner and outer bags are integrally formed and connected at fold lines.

14. The package as recited in claim 11, wherein said zipper and said inner bag are integrally formed.

15. The package as recited in claim 11, wherein said first zipper part comprises a first extension flange and said second zipper part comprises a second zipper flange, said first inner bag wall being joined to an inner surface of said first extension flange, said first outer bag wall being joined to an outer surface of said first extension flange, said second inner bag wall being joined to an inner surface of said second extension flange, and said second outer bag wall being joined to an outer surface of said second extension flange.

16. A package comprising:

an outer bag having an interior volume and a mouth;

a flexible zipper comprising first and second interlockable zipper parts that are interlocked to close said mouth and separated to open said mouth; and an inner bag residing in said interior volume when in a retracted position and extending through said mouth and outside said outer bag when said inner bag is turned inside out, wherein a portion of said inner bag that includes a terminus of said inner bag is inverted and folded along a fold line, said inverted portion being directed toward said mouth when said inner bag is in said retracted position wherein a portion of said inverted portion of said inner bag is sealed to a portion of said inner bag not included in said inverted portion.

17. The package as recited in claim 16, said first zipper part comprises a first extension flange and said second zipper part comprises a second extension flange, said inner bag further comprising first and second base portions respectively joined to said first and second extension flanges.

18. The package as recited in claim 16, wherein said inner and outer bags are integrally formed and connected at fold lines.

19. The package as recited in claim 16, wherein said seal is spot-shaped.

20. The package as recited in claim 16, wherein said zipper and said inner bag are integrally formed.

21. The package as recited in claim 16, wherein said first zipper part comprises a first extension flange and said second zipper part comprises a second zipper flange, said first inner bag wall being joined to an inner surface of said first extension flange, said first outer bag wall being joined to an outer surface of said first extension flange, said second inner bag wall being joined to an inner surface of said second extension flange, and said second outer bag wall being joined to an outer surface of said second extension flange.

22. The package as recited in claim 16, wherein each of said first and second inner bag walls of said funnel portion is generally trapezoidal in shape.

23. The package as recited in claim 16, wherein each of said first and second flap walls is generally triangular in shape.

24. The package as recited in claim 16, further comprising a slider mounted to and cooperating with said zipper, said slider causing portions of said first and second interlockable zipper parts to interlock when said slider is moved in a first direction and to separate when said slider is moved in a second direction opposite to said first direction.

* * * * *